United States Patent [19]

Ohmi et al.

[11] 4,379,512

[45] Apr. 12, 1983

[54] CLOSURE HAVING AN IMPROVED LINER

[75] Inventors: Hidehiko Ohmi, Hiratsuka; Katsuhisa Kitagawa, Kasugai; Shoji Morimoto, Komaki; Tateo Kubo, Hiratsuka; Misao Ohno, Komaki; Seitaro Takahashi, Komaki, all of Japan

[73] Assignee: Toyo Seikan Kaisha, Ltd., Tokyo, Japan

[21] Appl. No.: 208,398

[22] Filed: Nov. 19, 1980

[30] Foreign Application Priority Data

Nov. 24, 1979 [JP] Japan ..... 54-151334

[51] Int. Cl.[3] ..... B65D 53/04

[52] U.S. Cl. ..... 215/327; 215/343; 215/DIG. 1

[58] Field of Search ..... 215/343, 344, 345, 324, 215/325, 327, DIG. 1

[56] References Cited

U.S. PATENT DOCUMENTS

| | | | |
|---|---|---|---|
| 3,815,771 | 6/1974 | Marks | 215/344 |
| 3,844,439 | 10/1974 | Demers et al. | 215/344 |
| 3,851,784 | 12/1974 | Grynecewicz | 215/344 |
| 4,036,388 | 7/1977 | Davidson | 215/343 X |
| 4,106,653 | 8/1978 | Martinelli | 215/DIG. 1 |
| 4,114,775 | 9/1978 | Shinozaki | 215/343 |

FOREIGN PATENT DOCUMENTS

| | | | |
|---|---|---|---|
| 231993 | 12/1960 | Australia | 215/DIG. 1 |
| 564461 | 7/1975 | Switzerland | 215/344 |

*Primary Examiner*—Donald F. Norton
*Attorney, Agent, or Firm*—Pennie & Edmonds

[57] ABSTRACT

A closure (2) having a metal shell (4) and a synthetic resin liner (10) having a first annular projection (12) and a concentric second annular projection (14). The second annular projection is adapted to engage and seal with an upper surface (**24*b*) of the mouth (18) of a container with an inner peripheral surface (12*a*) of the second annular projection is adapted to engage the outer peripheral surface (24*a*) of the mouth (18**) of the container.

4 Claims, 12 Drawing Figures

FIG. 10
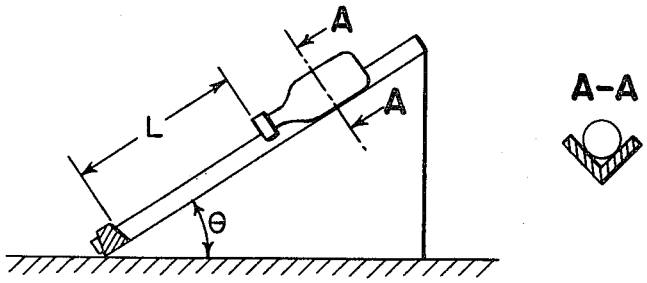
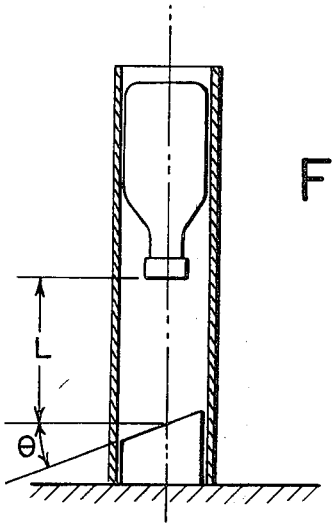
FIG. 11
FIG. 12
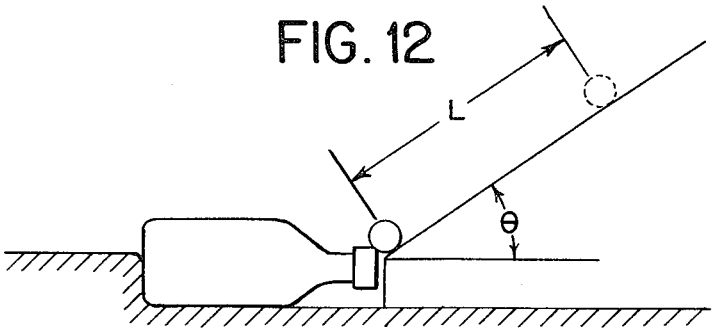

CLOSURE HAVING AN IMPROVED LINER

TECHNICAL FIELD

The present invention relates to a closure for a container and more particularly, to a closure of a type that has (a), a metal shell including a circular top surface and a substantially cylindrical skirt depending from the circular top surface, and (b), a synthetic resin liner that has been press formed inside the top of the shell.

BACKGROUND ART

In closures having a metal shell and depending skirt, it is very important that the shape of the synthetic resin liner installed inside the top of the shell have good sealing properties when applied to a container. In Japanese Patent Early Disclosure Number 53-65184, there is disclosed a liner having (a), an outer annular projection that provides an outer peripheral surface that is adapted to contact the outer peripheral surface of a mouth of a container to be sealed, and (b), an inner annular projection that provides an outer peripheral surface that contacts the inner peripheral surface of the mouth. Closures provided with liners of this type have sealing properties that are improved as compared to closures provided with liners of the types heretofore offered.

Experiments performed by the present inventors, however, have indicated that there is a problem in that the closures as described above have decreased sealing properties when they undergo impacts of considerable size.

It is therefore an object of the present invention to improve the shape of liners in closures of the type described above so that sufficient sealing properties will be retained even when these closures are subjected to considerable impact forces.

GENERAL DESCRIPTION OF THE INVENTION

We have found that a closure of the type described above may have its impact resistance considerably improved if, after the closure is applied to the mouth of a container, the liner has a shape so that the inner peripheral surface of a first annular projection engages the outer peripheral surface of the mouth and so that a second annular projection is positioned against the top surface of the mouth.

Broadly described, a closure constructed according to the present invention has (a), a metal shell having a circular upper surface and a substantially cylindrical skirt depending from the outer edge of the circular upper surface, and (b), a synthetic resin liner press formed on the inside of the upper surface of the shell. The liner has a first annular projection concentric with and radially outward of a second annular projection. The first annular projection provides an inner peripheral surface that is adapted to contact the outer peripheral surface of the mouth of a vessel that is to be sealed. The closure is characterized in that the second annular projection is positioned so that it is adapted to lie against the upper surface of the mouth and to seal with the upper surface of the mouth.

Preferably, the projected height of the second annular projection is less than the projected height of the first annular projection, and the second annular projection gradually decreases in thickness toward the projected end. The second annular projection preferably has its outer peripheral surface inclined in a radial direction toward the projected end, and should be formed so that it bends in the radial direction when it is sealed to the upper surface of the mouth. It is also possible to form the liner, as may be required, so that it has a third annular projection inside the said second annular projection where this third annular projection has an outer surface adapted to be positioned against the inner peripheral surface of a mouth of a container.

A closure of the present invention is adapted for use as a so-called roll-on type of closure where screw threads are formed on the outer peripheral surface at the mouth of the container that is to be sealed, and where the closure is sealed to the mouth part by applying deformation forces along the screw threads in the skirt portion of the shell so that a shoulder of the shell is deformed inward in the radial direction where it mounts and seals the mouth. However, the present invention is not restricted to closures of this specific type, and the invention can also be applied to closures of the ordinary roll-on type where no deformation is applied to a shoulder of the shell and to closures of various sorts such as the so-called screw type closures where screw threads are previously formed in the skirt before mounting of the closure on the container.

BEST MODES FOR CARRYING OUT THE INVENTION

Figure 1:
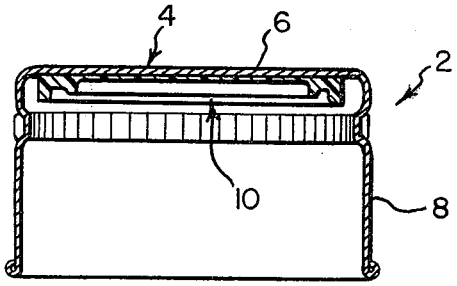
FIG. 1 is a cross-sectional view of a closure constructed according to the invention.

Referring to FIG. 1, there is illustrated a closure 2 including a metal shell 4 having a circular upper surface 6 and a substantially cylindrical skirt 8 depending from the outer edge of the circular upper surface. A synthetic resin liner 10 is press formed on the inside of upper surface 6 of shell 4. Metal shell 4 can be formed by a suitable method known to those skilled in the art from suitable metal elements that are easily deformable and may also be press formed using sheets of aluminum based alloys, tin plate or chromium plated sheet, and particular aluminum based alloy sheet. Synthetic resin liner 10 is made by press forming synthetic resins such as polyolefin resins including polyethylene and polyvinyl chloride, following known methods (for example methods as disclosed in Japanese Patent Publication 40-13156, Japanese Patent Publication 41-5588, Japanese Patent Publication 48–5706, Japanese Patent Publication 48–19886, Japanese Patent Early Disclosure 49–105689, U.S. Pat. Nos. 3,135,019, 3,212,131 and 3,278,985).

Figure 2:
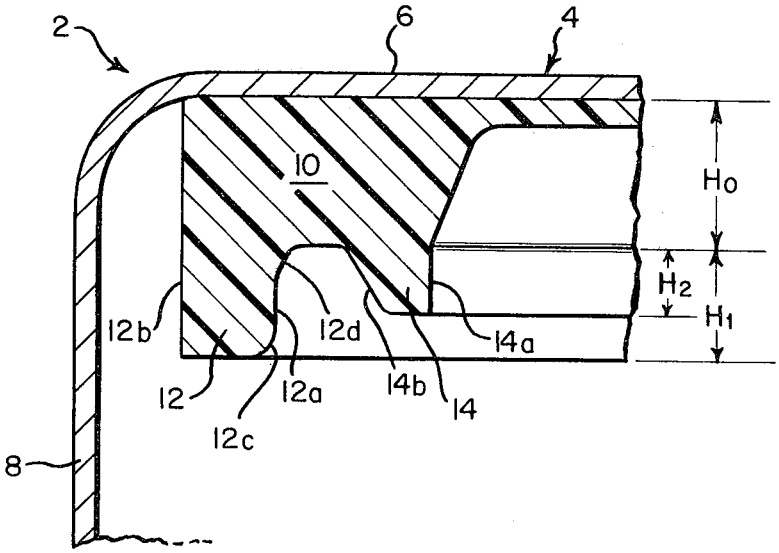
FIG. 2 is an enlarged partial view of FIG. 1.

The liner 10 according to the present invention has, as shown in FIG. 2, two concentric annular projections 12 and 14. The outer first annular projection 12 is formed so that it will furnish an inner peripheral surface 12*a* that is adapted to contact the outer peripheral surface of the end of a mouth of a container when the closure is mounted and sealed onto the mouth of the container as will be explained later. The first annular projection 12 should be positioned at a considerable interval from the inner surface of a skirt 8 of shell 4 and should be installed substantially perpendicular to top surface 6 of shell 4, and inner peripheral surface 12*a* and outer peripheral surface 12*b* should both be substantially perpendicular to top surface 6 of shell 4. It is also desirable that the tip 12*c* of the inner surface be inclined outwardly toward the radial direction from the standpoint of ease of engagement with the mouth of a container. It is also desirable that base 12*d* of the inner peripheral surface form a footing that is inclined inwardly in the radial direction with the object of reinforcing first annular projection 12 and for ease of press forming.

Figure 3:
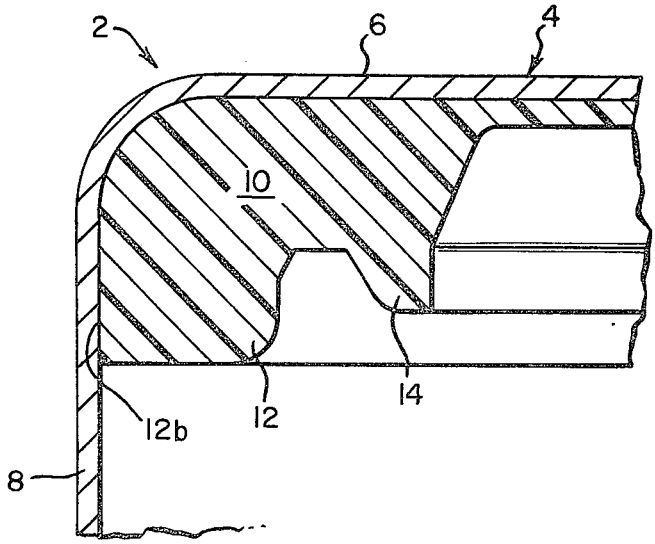
FIG. 3 is a view similar to FIG. 2 of a second embodiment of a closure constructed according to the invention.
Figure 4:
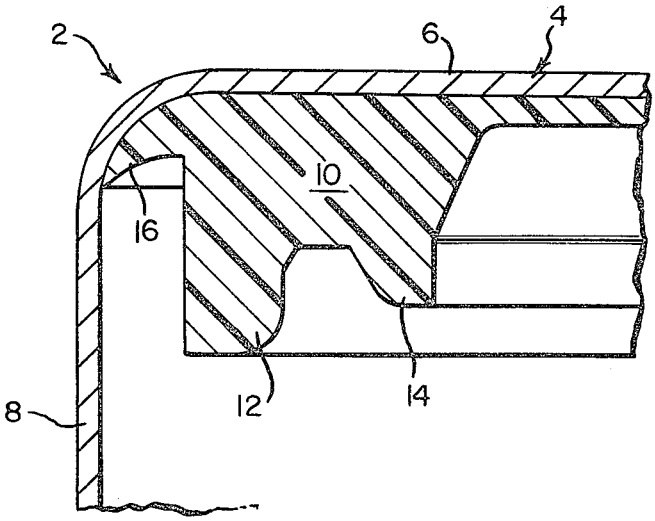
FIG. 4 is a view similar to FIG. 2 of a third embodiment of a closure constructed according to the invention.

When there is considerable likelihood of fairly large impact forces acting on the shoulder of shell 4 (that is, at the boundary between top surface 6 and skirt 8), it is desirable to form outer peripheral surface 12*b* of first annular projection 12 so that it contacts the inner surface of skirt 8 of shell 4 as shown in FIG. 3, or to form a projecting cuff 16 between first annular projection 12 and skirt 8 of shell 4 as shown in FIG. 4 in order to increase the resistance to such impact forces.

Second annular projection 14 is positioned on the inside of the first annular projection 12 and is arranged so as to be adapted to be positioned against the top surface of the mouth of a container to be sealed as will be explained further below. It is important that the second annular projection closely contact the upper surface of the mouth of the container when closure 2 is mounted and sealed on the mouth of the container. To the extent that these conditions are satisfied, second annular projection 14 can be of any desired shape, but from the standpoints of adhesion strength against the top surface of the mouth of the container (this has an effect on sealing properties), ease of press forming and other various elements, the form illustrated in detail in FIG. 2 is the preferred form. In the preferred form of FIG. 2 it is seen that:

(1) the projected height H2 of the second annular projection is smaller than the projected height H1 of the first annular projection 12, (2) the thickness of the second annular projection gradually decreases toward the projected end, and (3) the inner peripheral surface 14*a* is substantially perpendicular to the upper surface of shell 4 while the outer peripheral surface 14*b* is inclined inwardly in the radial direction toward the end of the projection, so that it bends inwardly in the radial direction when fastened to the upper surface of the mouth of the container as will be explained hereinafter.

The dimensions of liner 10 following the mode described can be based on the dimensions of each part of the mouth of a container to be sealed. Table 1 illustrates the dimensions of each part of a liner 10 relative to the outer diameter D1 and the inner diameter D2 of the mouth of a container as shown in FIG. 5 having the dimensions as set out in Table 1.

TABLE 1

| | Suitable Ranges | Particularly Suitable Ranges |
|---|---|---|
| Outer diameter d1 of first annular projection 12 | 1.03 D1–1.10 D1 | 1.05 D1–1.08 D1 |
| Inner diameter d2 of first annular projection 12 | 0.96 D1–1.02 D1 | 0.98 D1–1.01 D1 |
| Outer diameter d3 of second annular projection 14 | 0.90 D1–0.97 D1 | 0.92 D1–0.94 D1 |
| Inner diameter d4 of second annular projection 14 | 1.02 D2–1.15 D2 | 1.05 D2–1.12 D2 |
| Projection height H1 of first annular projection 12 | 0.5 mm–1.6 mm | 0.85 mm–1.2 mm |
| Projection height H2 of second annular projection 14 | 0.4 mm–1.0 mm | 0.6 mm–0.8 mm |
| Thickness H0 of the base between first annular projection 12 and second annular projection 14 | 0.5 mm–1.8 mm | 1.0 mm–1.6 mm |

Figure 5:
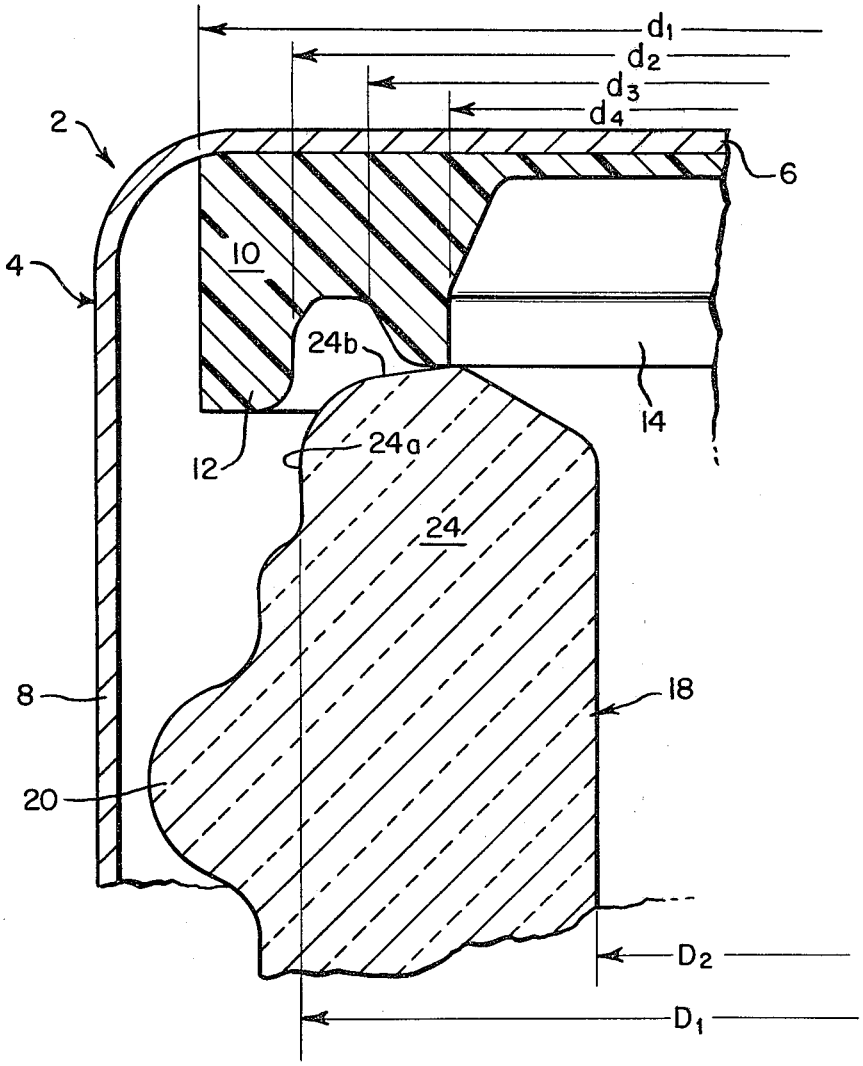
FIG. 5 is a view of the closure of FIG. 2 before sealing emplacement on a container.
Figure 6:
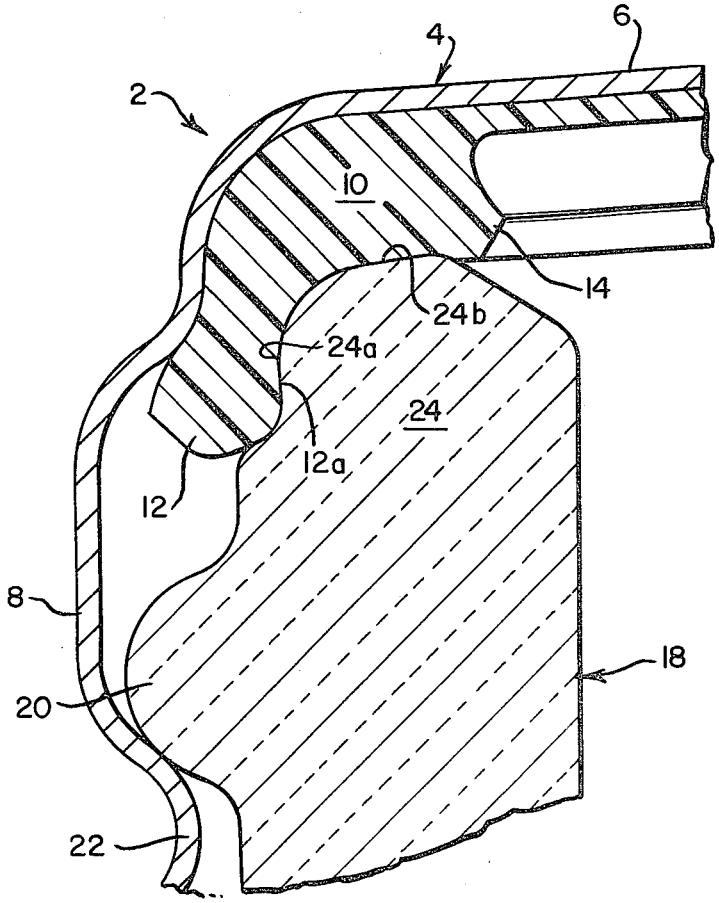
FIG. 6 is a view of the closure of FIG. 2 in sealing emplacement on a container.

The mounting and sealing of a closure 2 on the mouth 18 of a container is illustrated in FIGS. 5 and 6. As is well known to persons skilled in the art, closure 2 is placed over the mouth 18 after which it is pressed down on mouth 18 by applying pressure to the outer surface of upper surface 6 of shell 4. Under these conditions, skirt 8 of shell 4 deforms along screw thread 22 formed by the outer peripheral surface of mouth 18 to form screw thread 22 on skirt 8 (roll-on process), while the shoulder of shell 4 deforms inwardly in the radial direction. When this is done, closure 2 is firmly retained against mouth 18 by the engagement between screw thread 20 of mouth 18 and screw thread 22 formed by skirt 18, thus sealing mouth 18.

When the closure 2 is thus mounted and sealed on mouth 18 of the container, first annular projection 12 of liner 10 deforms elastically to the shape illustrated in FIG. 6, based on the fact that closure 2 is compressed downward in FIGS. 5 and 6 and on the fact that the shoulder of shell 4 is deformed inwardly in the radial direction. The inner peripheral surface 12*a* will contact outer peripheral surface 24*a* of mouth end 24 of mouth 18 of the container. The second annular projection 14 of liner 10 will be in direct contact with top surface 24*b* of mouth end 24, based on the fact that closure 2 is compressed downward in FIG. 5 and 6, and by the means as shown in FIG. 6, the second annular projection bends elastically inwards in the radial direction, and contacts the upper surface 24*b* of mouth end 24. The sealing of mouth 18 of the container is accomplished and maintained by the fact that inner peripheral surface 12*a* of first annular projection 12 contacts the outer peripheral surface 24*a* of mouth end 24 while second annular projection 14 contacts the top surfce 24*b* of mouth end 24.

Figure 7:
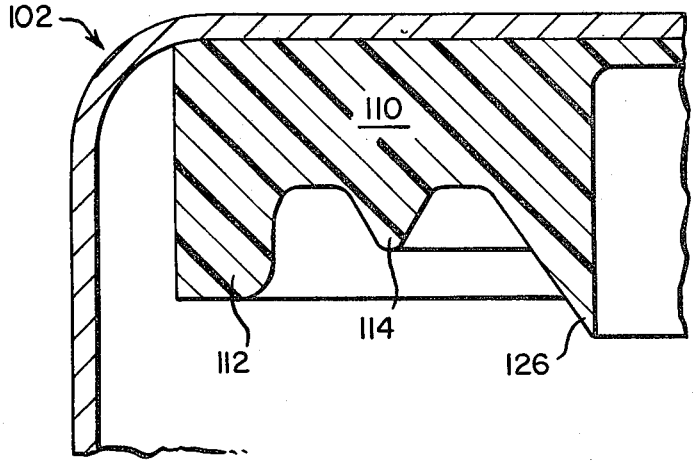
FIG. 7 is a view similar to FIG. 2 of a fourth embodiment of a closure constructed according to the invention.

FIG. 7 illustrates an example of deformation of a liner that includes a third annular projection. As shown, liner 110 has a first annular projection 112 and second annular projection 114 the same as first annular projection 12 and second annular projection 14 provided on liner 10 described above, and in addition has a third annular projection 126 positioned inside second annular projection 114. This third annular projection 126, as illustrated in detail in FIG. 8, furnishes outer peripheral surface 126*a* positioned against inner peripheral edge 124*d* of the upper surface of the container and inner peripheral surface 124c of the mouth end 124 of the container.

Figure 8:
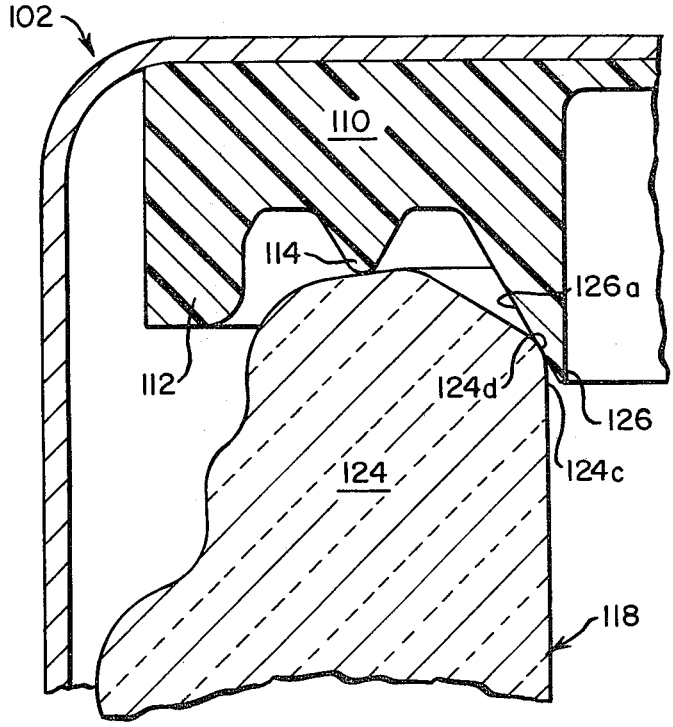
FIG. 8 is a view of the closure of FIG. 7 before sealing emplacement on a container.

When closure 102 containing liner 110 is placed over mouth 118 of a container and pressed downward as shown in FIG. 8, the inner peripheral surface 126a of third annular projection 126 will contact inner peripheral edge 124d of the upper surface and outer peripheral surface 124c of mouth end 124 of the container. By these means closure 102 is guided exactly into the required position and is positioned against mouth 118. Consequently, it is possible to have the so-called inclined pullover, with nearly total absence of mounting defects such as top cracking and wringing defects.

Figure 9:
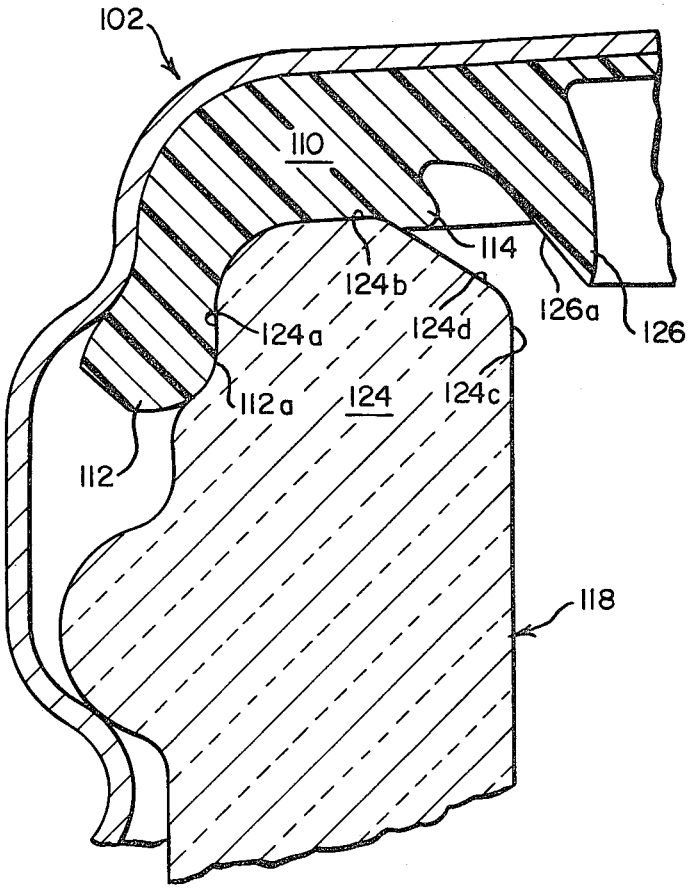
FIG. 9 is a view of the closure of FIG. 7 in sealing emplacement on a container; and, FIGS. 10, 11 and 12 are explanatory diagrams of impact tests carried out on containers having closures constructed according to the invention.

When closure 102 is sufficiently pressed against mouth 118 of the container and mounted and sealed as required, third annular projection 126 is elastically deformed as shown in FIG. 9, and parts from mouth end 124 of the container. Of course, it is also possible to emplace third annular projection 126 so that when closure 102 is mounted and sealed as required to mouth 118 of the container, outer peripheral surface 126a of third annular projection 126 will seal onto inner peripheral edge 124d of the top surface and inner peripheral surface 124c of mouth end 124 of the container. However, when this is done, a part of the contact and sealing pressures between liner 110 and container mouth 124 will be borne by the sealing between outer peripheral surface 126a of third annular projection 126 and inner peripheral edge 124d and inner peripheral surface 124c of mouth 124. This alone will decrease the sealing pressure between inner peripheral surface 112a of first annular projection 112 and outer peripheral surface 124a of mouth end 124, and the sealing pressure between second annular projection 114 and upper surface 124b of mouth end 124. Based on this, the sealing properties are considerably reduced when closures 102 are subjected to impact forces.

EXAMPLES AND COMPARATIVE EXAMPLES

Printing and a vinyl protective lacquer were painted onto one surface of a piece of aluminum base alloy sheet 0.25 mm thick, and the other surface was painted with an epoxy paint containing polyethylene oxide. The sheet was then pressed formed into shells so that the surfaces painted with epoxy paint containing polyethylene oxide became the inside surface of metal shells in the shape shown in FIG. 1. High pressure polyethylene (density=0.92 melt index=4.0) heated at 220° C. was inserted into the shells which had been preheated to about 180° C., was then press formed to form liners of the shape shown in FIGS. 1 and 2, to make sample closures of the present invention. The measurements of each part of the liners were as follows:

- Outer diameter d1 of first annular projection: 35.9 mm
- Inner diameter d2 of first annular projection: 33.8 mm
- Outer diameter d3 of second annular projection: 31.6 mm
- Inner diameter d4 of second annular projection: 30.5 mm
- Projection height H1 of first annular projection: 1.2 mm
- Projection height H2 of second annular projection: 0.7 mm
- Thickness HO of the base between the first annular projection and the second angular projection: 1.55 mm For purposes of comparison, comparative closures identical to the examples of the present invention described above were made except that the liner shape was like that illustrated in FIG. 4 of Japanese Early Disclosure 53-65184.

Then the closures comprising examples of the present invention and comprising the comparative examples were applied to the mouths of containers whose mouth ends had an outer diameter D1=33.83 mm and an inner diameter D2=2.70 mm. Impact tests were then conducted as described below.

Impact Test 1

As shown in FIG. 10, sulfuric acid and sodium hydrocarbon were packed in amounts of 1,000 ml into 1,000 ml containers after which the containers were sealed with sample closures. The containers were then left to stand in an upright position for one day in an isothermal chamber at 40° C. The containers were then placed with their mouths pointing downwardly on a stand inclined at an angle $\theta=30°$ and which had a high density polyethylene surface pasted thereon having a coefficient of friction of 0.08. The containers were placed on the stands at starting positions so as to give a total travel of 1=100, 200 and 300 mm. The containers were then allowed to fall naturally onto plastic and concrete masses emplaced at the lower end respectively. The number of containers tested for each test condition was n=10. The containers were left on their sides for one day after impact at ordinary temperatures, were further stood upright for one day, and then the number of containers with leakage was investigated. The results are shown below in Table 2.

Impact Test 2

As shown in FIG. 11, sample containers identical to those used in impact test 1 were placed with their mouths facing downward inside a perpendicular cylinder respectively at points where the drop distances were 1=30, 50, 70 and 100 mm. The samples were then dropped onto a steel mass having an angle of incline of $\theta=10°$ emplaced in the cylinder bottom. The number of containers tested for each test condition was n=10. After impact the containers were treated in the same manner as in impact test 1, and then the number of containers suffering leakage was investigated. These results are shown below in Table 3.

Impact Test 3

As shown in FIG. 12, containers identical to those used in impact test 1 and impact test 2 were placed on their sides and secured in place. Steel cylinders 45 mm in diameter, 50.8 mm high and 625 g in weight were then released toward the mouth ends on an inclined stand having an angle of incline of $\theta=30°$. The number of containers was n=10. Each cylinder was released from a point where the falling motion distance 1 was 200 mm, and after impact frequencies respectively of 3, 5 and 7 times each, the containers were treated in the same manner as in impact tests 1 and 2, and the number of containers with occurrence of leakage was investigated. The results are in Table 4 below.

In the several impact tests described above, those containers where the initial gas volume setting of 4 Vol decreased to below 3.7 Vol in measured values were taken as having undergone leakage (also, 1 vol is the condition where the amount of carbonic acid gas dissolved in 1 cc of water at 15.5° C. under 1 atmosphere of pressure is 1 cc).

TABLE 2

| | Dropping Distance (mm) | Examples | Comparative Examples |
|---|---|---|---|
| Plastic mass | 100 | 0 | 0 |
| | 200 | 0 | 3 |
| | 300 | 6 | 10 |
| Concrete mass | 100 | 0 | 3 |
| | 200 | 2 | 9 |
| | 300 | 3 | 9 |

(The numerical values shown in Tables 1 and 2 above and Table 3 below depict the number of bottles incurring leakage among 10 samples.)

TABLE 3

| Dropping Distance (mm) | Examples | Comparative Examples |
|---|---|---|
| 30 | 0 | 9 |
| 50 | 0 | 10 |
| 70 | 0 | 10 |
| 100 | 1 | 10 |

TABLE 4

| Dropping Frequency | Examples | Comparative Examples |
|---|---|---|
| 3 | 0 | 0 |
| 5 | 0 | 7 |
| 7 | 9 | 9 |

We claim:

1. A closure including a metal shell having a circular top surface and a substantially cylindrical skirt depending from the peripheral edge of the top surface, and a synthetic resin liner press formed on the inside top surface of the shell with the liner having at least first and second concentric annular projections with said first annular projection being positioned radially outwardly of said second annular projection and with the inner peripheral surface of said first annular projection adapted to seal with the outer peripheral surface of a container including a mouth having an upper horizontal surface; the improvement comprising in that said second annular projection has a radial thickness such decreases towards a projection tip at the end thereof and has a radially outward peripheral surface inclined radially inwardly towards said tip with said tip adapted to initially contact the horizontal upper surface of a container to be bent inwardly when the shell and liner are sealed to a container and said radially outwardly peripheral surface adapted to be bent radially inwardly when positioned against an upper surface of a mouth of a container to form a seal therewith and in that a third concentric annular projection is positioned radially inwardly of said second annular projection and is adapted to initially contact an inner peripheral edge of the mouth when the shell and liner are sealed to a container and then to be bent inwardly to be spaced from the inner peripheral edge of the mouth.

2. A closure according to claim 1 wherein the projected height of said second annular projection is less than the projected height of said first annular projection.

3. A closure according to claim 1 wherein the mouth of said container has a screw thread on the outer periphery thereof and wherein said skirt is adapted to be deformed along said screw thread after said closure has been set over said mouth.

4. A closure according to claim 3 wherein said shell includes a shoulder thereon adapted to be deformed into said shell after it is applied to said mouth whereby the inner peripheral surface of said first annular projection is forced into sealing contact with the outer peripheral surface of said mouth.

* * * * *

UNITED STATES PATENT AND TRADEMARK OFFICE

CERTIFICATE OF CORRECTION

PATENT NO. : 4,379,512

DATED : April 12, 1983

INVENTOR(S) : HIDEHIKO OHMI ET AL.

It is certified that error appears in the above-identified patent and that said Letters Patent is hereby corrected as shown below:

Column 8, line 6, claim 1, "such" should read --which--;

Signed and Sealed this

*Fourteenth* Day of *June 1983*

[SEAL]

*Attest:*

DONALD J. QUIGG

*Attesting Officer*

*Acting Commissioner of Patents and Trademarks*